US006941872B2

(12) United States Patent
Roodenburg et al.

(10) Patent No.: US 6,941,872 B2
(45) Date of Patent: Sep. 13, 2005

(54) AMUSEMENT DEVICE

(75) Inventors: Joop Roodenburg, Delft (NL); Petrus Joseph Hubertus Clerx, Roermond (NL)

(73) Assignee: Vekoma Rides Engineering B.V., Vlodrop (NL)

( * ) Notice: Subject to any disclaimer, the term of this patent is extended or adjusted under 35 U.S.C. 154(b) by 0 days.

(21) Appl. No.: 10/612,543

(22) Filed: Jul. 1, 2003

(65) Prior Publication Data

US 2005/0098056 A1 May 12, 2005

(30) Foreign Application Priority Data

Jul. 4, 2002 (NL) ..... 1020996

(51) Int. Cl.[7] ..... A63G 1/00
(52) U.S. Cl. ..... 104/53
(58) Field of Search ..... 104/53, 56, 57, 104/74, 75, 76

(56) References Cited

U.S. PATENT DOCUMENTS

| | | | | |
|---|---|---|---|---|
| 1,502,699 A | 7/1924 | Traubel | | |
| 4,724,771 A | 2/1988 | Yamada | 104/56 | |
| 6,173,654 B1 * | 1/2001 | Ngai | 104/295 | |
| 6,342,017 B1 * | 1/2002 | Kockelman | 472/131 | |

FOREIGN PATENT DOCUMENTS

| | | | |
|---|---|---|---|
| DE | 288 600 | 11/1915 | |
| DE | 196 15 114 A1 * | 4/1997 | ..... B66F 7/00 |
| DE | 196 15 114 | 12/1997 | |
| DE | 198 16 768 | 11/1999 | |
| FR | 909 611 | 5/1946 | |
| FR | 2 599 988 | 12/1987 | |

OTHER PUBLICATIONS

English Language Abstract, FR2599988, Dec. 18, 1987, 1 page.
English Language Abstract, DE19615114, Dec. 4, 1997, 1 page.
English Language Abstract, DE19816768, Nov. 4, 1999, 1 page.

* cited by examiner

*Primary Examiner*—S. Joseph Morano
*Assistant Examiner*—Robert J. McCarry, Jr.
(74) *Attorney, Agent, or Firm*—MacPherson Kwok Chen & Heid LLP

(57) ABSTRACT

An amusement device comprising a vehicle that can be moved over an elongated track as well as a track portion that can be moved jointly with said vehicle from a first, relatively low position to a second, relatively high position, or vice versa, which track portion can connect to said elongated track. The track portion extends substantially horizontally in said first position, whereas the track portion extends at an angle to the horizontal in said second position.

29 Claims, 4 Drawing Sheets

AMUSEMENT DEVICE

The invention relates to an amusement device comprising a vehicle that can be moved over an elongated track as well as a track portion that can be moved jointly with said vehicle from a first, relatively low position to a second, relatively high position, or vice versa, which track portion can connect to said elongated track.

With an amusement device of this kind as known from German patent application DE-A1-198.16.768, a vehicle is moved jointly in vertical direction with a movable track portion from a first, relatively low position to a second, relatively high position. Near said high position, the movable track portion connects to the elongated track. An advantage of such a known amusement device is the fact that the base area required for moving the vehicle from the relatively low position to the relatively high position is comparatively limited.

Once the vehicle has been moved to the relatively high position, the vehicle is moved over the track under the influence of the force of gravity. The track may be designed to have various curves, such as bends, loops, so-called corkscrews etc. Once the vehicle has completed its path over the track, it is returned to the aforesaid relatively low position, from where it is moved to the aforesaid higher position again.

One drawback of the known amusement device is the fact that the movement in vertical direction of the track portion is not experienced as very spectacular by a person present in a vehicle present on said track portion.

The object of the invention is to provide an amusement device in which the vehicle can be moved to a different height position in a relatively simple manner, which movement is in addition comparatively interesting.

This objective is accomplished with the amusement device according to the invention in that the track portion extends substantially horizontally in said first position, whereas the track portion extends at an angle to the horizontal in said second position.

Since the track portion includes an angle with the horizontal near the second, higher position, a greater sense of excitement is experienced near said relatively high position. In addition, this arrangement makes it possible to move the vehicle over the track under the influence of the force of gravity directly after the track portion has connected to the track. As a result, no additional measures are required near said relatively high position for moving the vehicle off the track portion and onto the track.

One embodiment of the amusement device according to the invention is characterized in that the track portion extends substantially horizontally in said first position, whereas the track portion extends substantially vertically in said second position.

In this way persons can board the vehicle in the first horizontal position, after which the track portion is moved upwards in substantially vertical direction together with the vehicle. Subsequently, the track portion and the vehicle are jointly tilted near said second position, to a position in which the track portion extends substantially vertically. From said position the vehicle is released to be moved over the track.

Since the track portion can be moved substantially vertically upwards, the base area required for moving the vehicle upwards is comparatively limited.

Another embodiment of the amusement device according to the invention is characterized in that the track portion can be moved along a rail, during which movement the track portion extends substantially perpendicularly to the rail.

This makes it possible to move the track portion between said first and said second position in a relatively simple manner.

Yet another embodiment of the amusement device according to the invention is characterized in that the track portion can be moved by means of a cable that can be wound onto a drum.

The track portion can be moved from the first position to the second position in a relatively simple and reliable manner by means of a cable that can be wound onto said drum. Once the vehicle has been moved to the second position by means of the track portion, said track portion can furthermore be returned to the first position in a simple manner by means of the cable that can be wound onto said drum.

Yet another embodiment of the amusement device according to the invention is characterized in that the amusement device is provided with a device which comprises a number of pulleys and a safety cable passed over said pulleys, the two ends of which safety cable are connected to the movable track portion, whilst the pulleys can be moved by means of a piston-cylinder combination.

In this way the track portion is attached to the safety cable in a reliable manner. If the driving system of the track portion should fail, undesirable downward movement of the track portion will be prevented in a simple manner by the safety device. In addition, a permanent force can be exerted on the track portion by means of the piston-cylinder combination, which force forms a counterweight, as it were, for the weight of the track portion, possibly augmented with the weight of the vehicle to be moved. As a result of the presence of said counterweight, the force required for moving the track portion is relatively small.

The invention will be explained in more detail hereinafter with reference to the drawings, in which.

Like parts are indicated by the same numerals in the various Figures.

Figure 1:
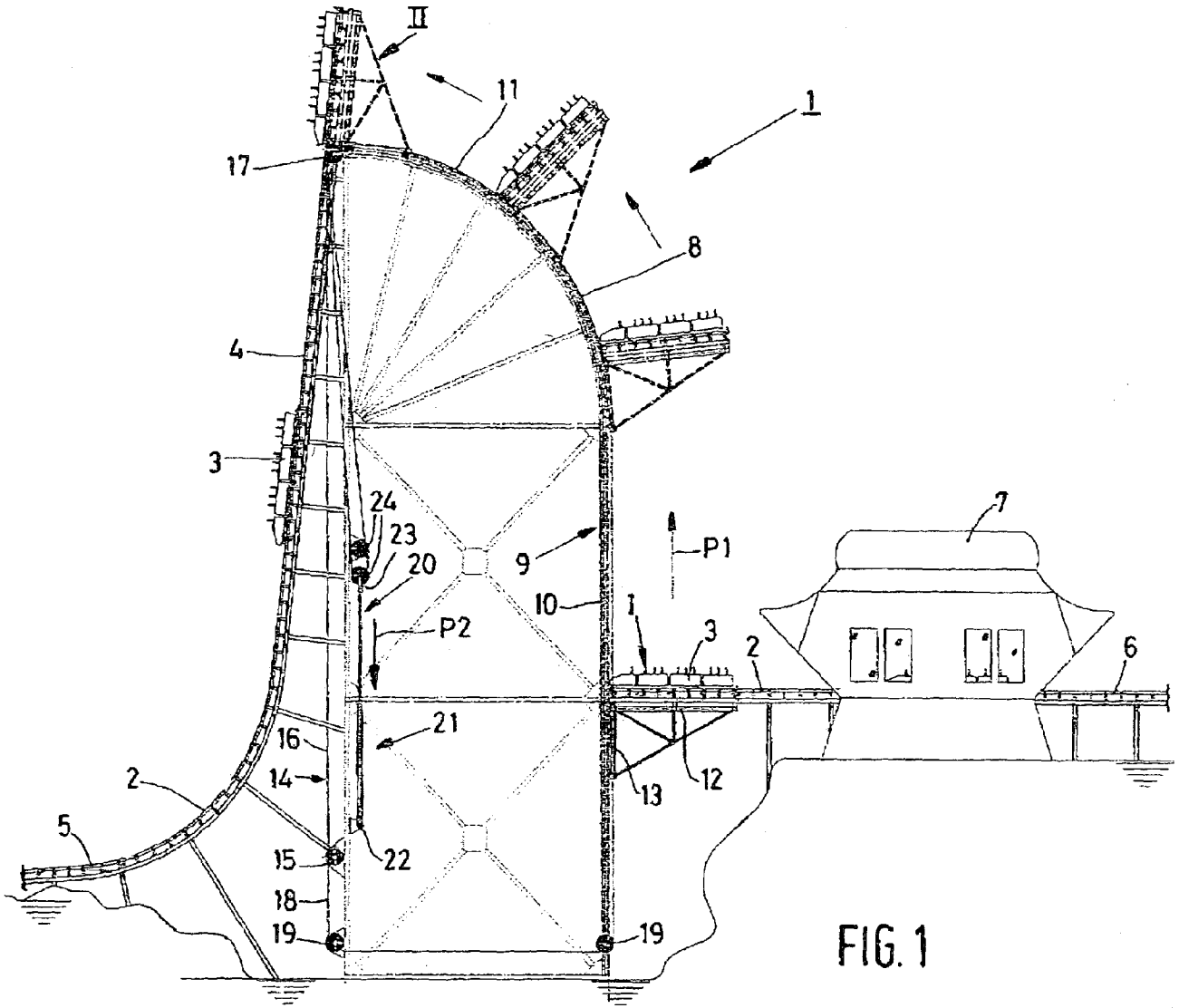
FIG. 1 shows a first embodiment of an amusement device according to the invention.

FIG. 1 is a side elevation of an amusement device 1 according to the invention, comprising an elongated track 2 over which a vehicle 3 can be moved. The elongated track 2 comprises a substantially vertical track portion 4, which blends, near a bottom side thereof, via a curved track portion 5, with a track portion (not shown) that is connected with an end thereof remote from the track portion 5 to a horizontal track portion 6, at which a boarding station 7 is present.

The amusement device 1 according to the invention furthermore comprises a tower 8 disposed between the track portion 4 and the track portion 6, which tower is provided with a rail 9 comprising a substantially vertical rail portion 10 and a quarter-circular rail portion 11 connecting thereto. An end of the rail portion 11 remote from the rail portion 10 is disposed near an end of the track portion 4 remote from the track portion 5.

A track portion 12 can be moved over said rail 9. The track portion 12 is supported on the rail portion 10 via a support 13. The track portion 12 connects to the track portion 6 in the position I that is illustrated in full lines in FIG. 1. The tower 8 is provided with a driving system 14, which comprises a cable 16 that can be wound onto a drum 15, which cable 16 is connected to the track portion 12 via rollers 17 and the rail 9. The driving system 14 furthermore comprises a cable 18 that can be wound onto the drum 15, which cable is connected to the track portion 12 via rollers 19.

Figure 5:
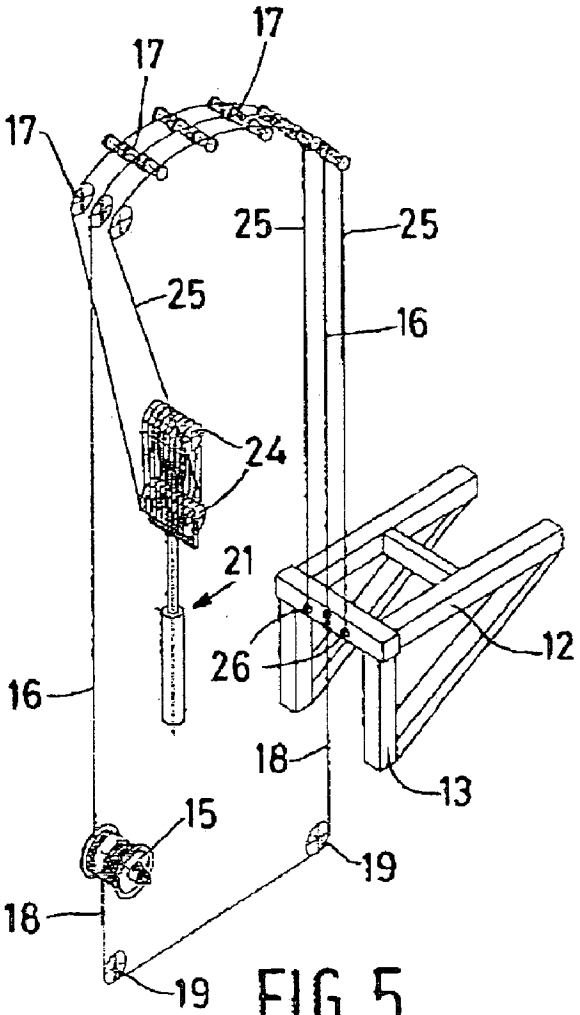
FIG. 5 shows a safety device of the amusement device according to the invention.

The tower 8 of the amusement device 1 is furthermore fitted with a safety device 20 comprising a piston-cylinder combination 21, which is rigidly connected to the tower 8 with an end 22 thereof. An end 23 of the piston-cylinder combination 21 remote from the end 22 is connected to a part comprising a number of pulleys. A cable 25 is passed over said pulleys 24, which cable is connected to the track portion 12 with both of its ends 26 (see FIG. 5).

The operation of the amusement device 1 will now be explained in more detail.

At the boarding station 7, passengers board the vehicle 3 that is present at said station. Then the vehicle 3 is moved over the track portion 6 to the track portion 12 by driving means (not shown) or under the influence of the force of gravity. Once the vehicle 3 is present on the track portion 12, it is interlocked with the track portion 12.

Figure 6:
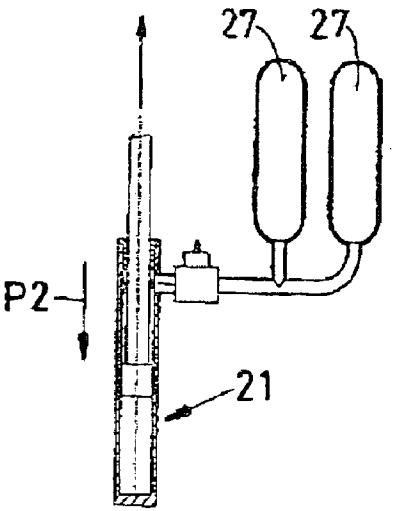
FIG. 6 shows a part of the safety device that is shown in FIG. 5.

Following that, the drum 15 is rotated, causing the cable 16 to be wound onto the drum and the track portion 12 to be moved upwards over the rail 9, in the direction indicated by the arrow P1, from the position indicated at I to the position indicated at II via the positions located therebetween. While the cable 16 is being wound onto the drum 15, the cable 18 is simultaneously unwound from said drum 15. Moreover, the piston-cylinder combination 21 is actuated by means of gas from the gas cylinders 21 when the track portion 12 is being moved upwards, as a result of which the pulleys 24 are moved in the direction indicated by the arrow P2 (see FIG. 6). The cable 25 is kept at a constant tension by the action of the piston-cylinder combination 21. Moreover, a force is exerted on the track portion 12 by means of the piston-cylinder combination 21, which force forms a counterforce or counterweight, as it were, for the weight of the track portion 12 and the vehicle 3 that is present thereon. If the cable 16 should break, the cable 25 will stop the track portion 12 and the vehicle 3 present thereon in such a manner as to prevent the track portion 3 from returning to the position I uncontrolledly at a relatively high velocity. The track portion is slowly returned to the position I by means of the piston-cylinder combination 21.

After the track portion 12 and the vehicle 3 present thereon have been moved to the position II by means of the driving mechanism 14, the locking engagement between the vehicle 3 and the track portion 12 is released, whereupon the vehicle 3 will start to move over the track portion 4. Once the vehicle 3 has been transferred from the track portion 12 to the track portion 4, the drum 15 is driven in reverse direction, as a result of which the cable 18 will be wound onto the drum and the track portion 12 will be moved in the opposite direction of the arrow P1 from the position II to the position I. At the same time, the cable 16 is unwound from the drum 15.

Since the track portion 12 of the amusement device 1 according to the invention is moved substantially vertically upwards, the area required for moving the vehicle 3 from the position I to the position II is relatively small. In addition, any difference in height between the positions I and II that may be desired can be realised in a simple manner by adapting the height of the tower 8.

Figure 2:
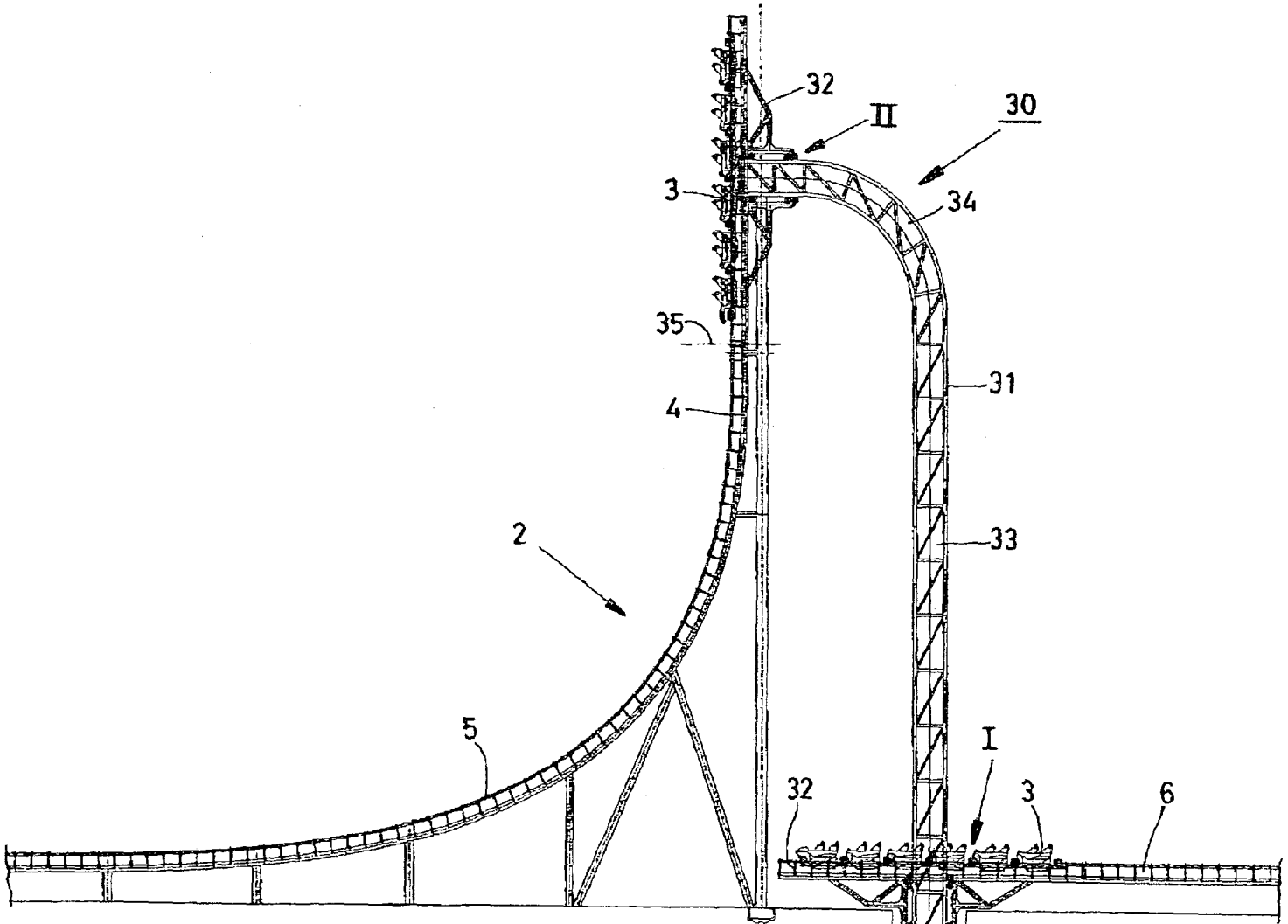
FIG. 2 shows a second embodiment of an amusement device according to the invention.

FIG. 2 shows a second embodiment of an amusement device 30 according to the invention, which comprises a rail 31 and a track portion 32 that can be moved over said rail 31. Unlike the amusement device 1 that is shown in FIG. 1, the track portion 32 is not positioned on one side of the rail in this embodiment, but it extends on either side of the rail 31. The rail 31 comprises a substantially vertical portion 33 near an upper side thereof and a curved portion 34 connecting thereto. The track portion 32 and the vehicle 3 present thereon can be moved from a relatively low position I to a relatively high position II. In said position II, the track portion 32 and the vehicle 3 present thereon extend substantially vertically. The track portion 32 connects to a track portion 4 of the track 2 near a connecting line 35. Once a proper connection between the track portion 32 and the track portion 4 has been effected, the locking engagement between the vehicle 3 and the track portion 32 is released and the vehicle will start to move to the track portion 6 via the track portion 4 and the track portion 5.

Figure 3:
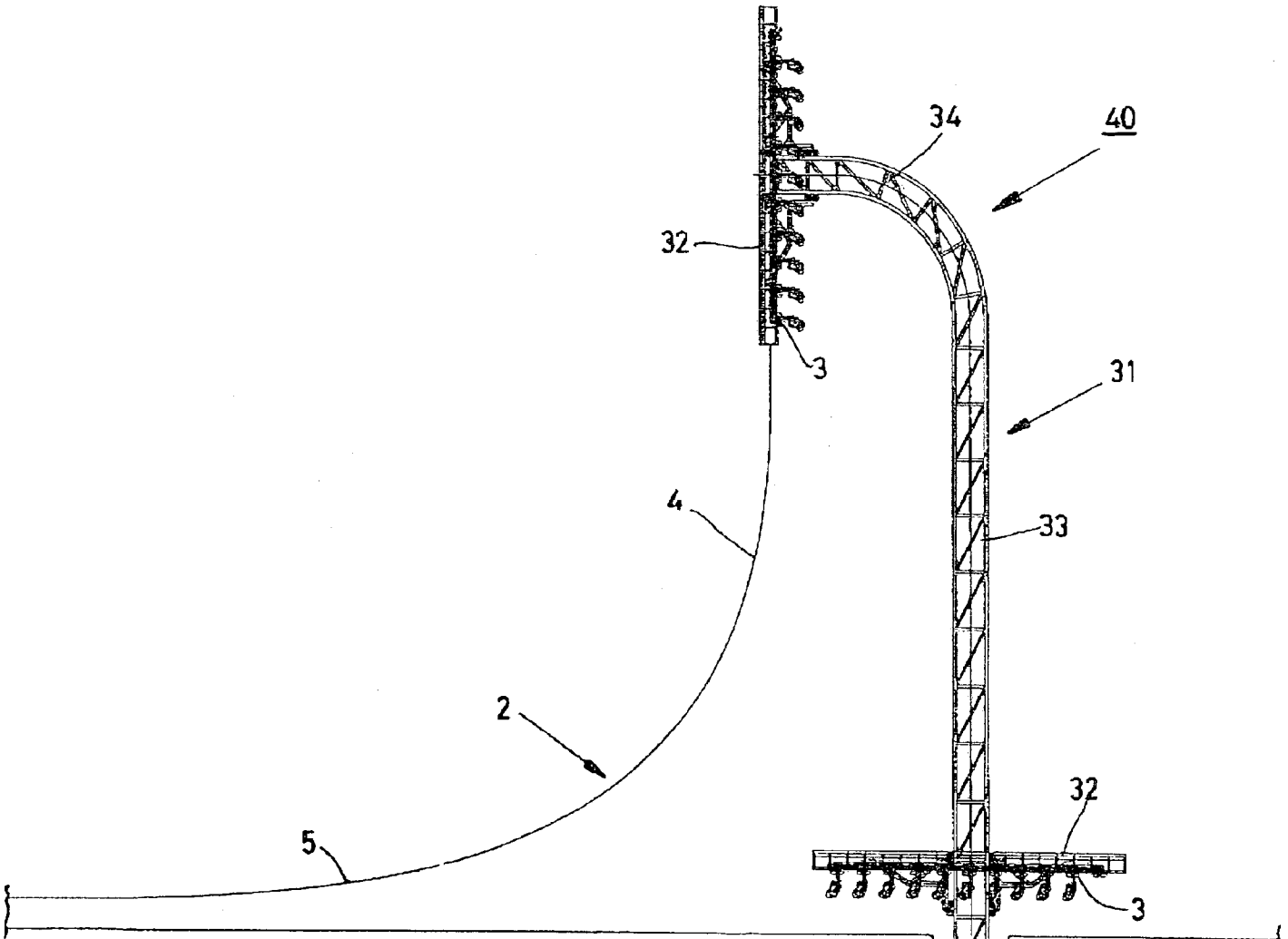
FIG. 3 shows a third embodiment of an amusement device according to the invention.

FIG. 3 shows a third embodiment of an amusement device 40 according to the invention, in which the vehicle 3 is present on a bottom side of the track portion 32 rather than on an upper side of said track portion 32. The track portion is moved in upward direction together with the vehicle 3 in the same manner as described with reference to FIG. 2, however, and subsequently tilted through 90°, after which the vehicle 3 can be moved over the track 2.

Figure 4:
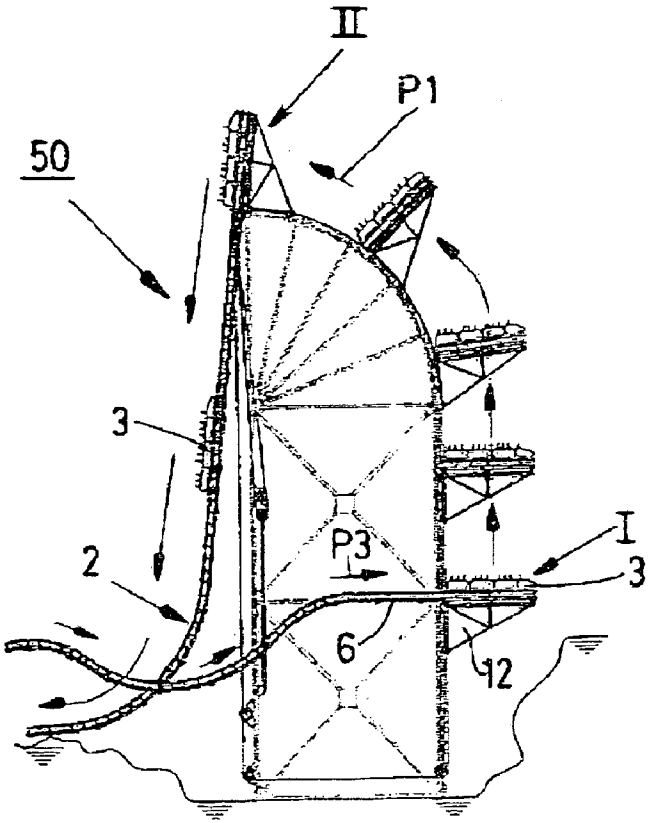
FIG. 4 shows a fourth embodiment of an amusement device according to the invention.

FIG. 4 shows a fourth embodiment of an amusement device 50 according to the invention in which, unlike the amusement device 1 that is shown in FIG. 1, the track portion 6 connects to the track portion 12 from the left-hand side rather than from the right-hand side. A vehicle 3 moving over the track portion 6 in the direction indicated by the arrow P3 will be moved over the track portion 4 after being taken from position I to position II by means of the movable track portion 12. The part of the vehicle 3 that formed the front end during said movement over the track portion 6 will form the rear end during the movement of the vehicle 3 over the track portion 4. Thus the direction of movement of the vehicle 3 can be changed in a simple manner.

It is also possible to have the track portion 4 include a considerable angle with the vertical, so that the descent along the track portion 4 will be less fast.

Furthermore it is possible to move the track portion 12 only vertically upwards, in which case the track portion 12 and the vehicle 3 present thereon will be tilted about an axis near the upper position II, thus achieving a connection to a track portion 4. In this way it is possible to further reduce the base area required for moving the vehicle 3 in upward direction.

It is also possible to use other safety devices, for example mechanical safety devices, for preventing the track portion from moving downwards undesirably.

Any guide that corresponds to or deviates from the rest of the track as regards its construction and structure may be used as the track portion by means of which a vehicle can be moved from a first position to a second position.

It is also possible to move the vehicle from the upper position to the lower position by means of the track portion in an amusement device.

According to another possibility, the track portion may include an angle in the order of 30-90° with the horizontal near said high position, as a result of which the vehicle present on said track portion will directly start to move over the track from said track portion, in which case the persons present in the vehicle will experience some form of excitement during the upward movement already, due to the tilting movement of the track portion on which the vehicle is present.

What is claimed is:

1. An amusement device for providing a sense of excitement to one or more persons using the amusement device, said amusement device comprising:

(a) a detachable and movable track section adapted to support a track-following vehicle, the vehicle being sufficiently large to carry one or more of said persons using the amusement device, the movable track section being elongated to generally define a corresponding first axis of elongation;

(b) a driving system adapted to move the movable track section between a relatively low first position and a higher second position;

(c) a tilter operatively coupled to the movable track section to cause the first axis of elongation of the movable track section to be tilted into a substantially horizontal first angle when the movable track section is in said first position and to cause the first axis of elongation to be tilted into a substantially non-horizontal second angle when the movable track section is in said second position, the second angle being sufficiently non-horizontal so that if the vehicle and vehicle-carried riders are supported by the movable track section at the time its first axis attains said second angle, the second angle provides a sense of enhanced excitement to the one or more persons carried in the vehicle beyond excitement provided merely by the vehicle and movable track section being at said higher second position; and (d) at least one track-continuation section to which the movable track section detachably attaches so that said track-following vehicle can move between a first support state in which the vehicle is supported by the movable track section and a second support state in which the vehicle is supported by the at least one track-continuation section, the movement of the track-following vehicle between the first and second support state occurring when the movable track section is attached to the at least one track-continuation section.

2. The amusement device of claim 1 wherein:

(c.1) said substantially non-horizontal second angle is in the order range of 30 to 90 degrees away from the horizontal.

3. The amusement device of claim 2 wherein:

(d.1) a first of said at least one track-continuation sections is located at the higher second position and is adapted to allow the vehicle to directly follow the first track-continuation section under force of gravity when the vehicle is released from the attached, movable track section while said substantially non-horizontal second angle is attained.

4. The amusement device of claim 1 wherein:

(c.1) the tilter tilts the first axis of elongation of the movable track section between the first and second angles at a same time while the driving system is moving the movable track section between the first and second positions.

5. The amusement device of claim 1 wherein:

(c.1) the tilter tilts the first axis of elongation of the movable track section to the second angle after the driving system has moved the movable track section to a position at or substantially near the second position.

6. The amusement device of claim 1 wherein:

(c.1) the tilter includes a guide rail that operatively couples to the movable track section while the movable track section is moving between the first and second positions, where the guide rail controls the angle of the first axis of elongation relative to the horizontal.

7. The amusement device of claim 6 wherein:

(c.1a) the guide rail includes a circular arc portion.

8. The amusement device of claim 6 wherein:

(c.1a) the guide rail includes a substantially vertical portion.

9. The amusement device of claim 6 wherein:

(c.2) the tilter includes a support structured to support the movable track section so that its first axis of elongation maintains a predefined third angle relative to a corresponding tangent of the guide rail while the movable track section moves in operative intercoupling with guide rail.

10. The amusement device of claim 9 wherein:

(c.2a) the third angle is about 90 degrees.

11. The amusement device of claim 1 wherein:

(d.1) said driving system includes a first cable operatively coupled to pull the movable track section up from the lower first position to the higher second position; and (d.2) said driving system includes a second cable operatively coupled to pull the movable track section down from the higher second position to the lower first position.

12. The amusement device of claim 11 wherein:

(d.1) said driving system includes a third cable operatively coupled to apply a counterweight force against the weight of at least one of said movable track section and said vehicle.

13. The amusement device of claim 12 wherein:

(d.1a) said third cable defines a safety loop with two opposed parts of the safety loop connected to the movable track section.

14. The amusement device of claim 12 wherein:

(d.1a) said third cable is coupled to a cylinder-piston combination which provides said counterweight force and inhibits the movable track section from falling rapidly in a case where the first cable fails to adequately support the movable track section.

15. The amusement device of claim 1 wherein:

(d.1) a first of said at least one track-continuation sections is located at the higher second position and is angled according to said substantially non-horizontal second angle so that the vehicle can continue its track-following motion at said second angle when moving between the movable track section and the first track-continuation section.

16. The amusement device of claim 15 wherein:

(d.2) a second of said at least one track-continuation sections is located at the lower first position and is angled according to said substantially horizontal first angle so that the vehicle can continue its track-following motion at said first angle when moving between the movable track section and the second track-continuation section.

17. The amusement device of claim 16 wherein:

(d.3) both of the first and second track-continuation sections extend in a generally same continuation direction so that a vehicle moving from one of the first and second track-continuation sections to the other by way of said movable track section undergoes a reversal of traveling direction, entering the movable track section while moving in a first traveling direction defined by said continuation direction and leaving the movable track section while moving in an opposite second traveling direction, and also experiencing a change of elevation in switching from one of the first and second track-continuation sections to the other.

18. The amusement device of claim 1 and further comprising:

(e) a first multi-section track-following vehicle adapted to carry a plurality of persons, where the movable track section is at least as long as the multi-section vehicle.

19. The amusement device of claim 18 and further comprising:

(f) a boarding station at which passengers can board said first multi-section track-following vehicle;

(d.1) wherein a first of said at least one track-continuation sections is located at the lower first position and is and is angled according to said substantially horizontal first angle so that the first vehicle can continue its track-following motion at said first angle when moving between the movable track section and the first track-continuation section; and (f.1) the boarding station is located along the first track-continuation section and spaced sufficiently away from said movable track section so that a second multi-section track-following vehicle can stop in the boarding station for boarding of additional passengers while the first multi-section track-following vehicle is being moved between the first and second positions while supported by the movable track section.

20. The amusement device of claim 1 wherein:

(a.1) said track section has an axis of tilt approximately midway along its first axis of elongation.

21. A method for operating an amusement device so as to provide a sense of excitement to one or more persons using the amusement device, said method comprising:

(a) supporting a first track-following vehicle on a movable track section, the vehicle being sufficiently large to carry one or more of said persons using the amusement device, the movable track section being elongated to generally define a corresponding first axis of elongation;

(b) moving the movable track section between a relatively low first position and a higher second position while the first vehicle is supported by the movable track section; and (c) while the first vehicle is supported by the movable track section, tilting the movable track section so as to cause the first axis of elongation of the movable track section to be tilted at a substantially horizontal first angle when the movable track section is in said first position and to cause the first axis of elongation to be tilted at a substantially non-horizontal second angle when the movable track section is in said second position, the second angle being sufficiently non-horizontal so that if the supported vehicle carries one or more passengers at the time the first axis attains said second angle, the second angle provides a sense of enhanced excitement to the one or more passengers beyond excitement provided merely by the vehicle and movable track section being at said higher second position.

22. The operating method of claim 21 and further comprising:

(d) detachably attaching the movable track section to at least one track-continuation section so that said track-following vehicle can move between a first support state in which the vehicle is supported by the movable track section and a second support state in which the vehicle is supported by the at least one track-continuation section, the movement of the track-following vehicle between the first and second support state occurring when the movable track section is attached to the at least one track-continuation section.

23. The operating method of claim 22 wherein:

(c.1) said substantially non-horizontal second angle is in the order range of 30 to 90 degrees away from the horizontal.

24. The amusement device of claim 23 wherein:

(d.1) a first of said at least one track-continuation sections is located at the higher second position and is adapted to allow the vehicle to directly follow the first track-continuation section under force of gravity when the vehicle is released from the attached, movable track section while said substantially non-horizontal second angle is attained.

25. The operating method of claim 21 wherein:

(c.1) said substantially non-horizontal second angle is in the order range of 30 to 90 degrees away from the horizontal.

26. The operating method of claim 21 wherein said moving of the movable track section includes:

(b.1) using a first cable to pull the movable track section up from the lower first position to the higher second position.

27. The operating method of claim 26 wherein said moving of the movable track section includes:

(b.2) using a second cable to pull the movable track section down from the higher second position to the lower first position.

28. The operating method of claim 27 wherein said moving of the movable track section includes:

(b.1) using a third cable to apply a counterweight force against the weight of at least one of said movable track section and said vehicle.

29. The operating method of claim 21 wherein said moving of the movable track section includes:

(b.1) using a piston-cylinder combination to apply a dynamically damped, counterweight force against the weight of at least one of said movable track section and said vehicle.

* * * * *